United States Patent [19]

Laffitte et al.

[11] 4,403,917

[45] Sep. 13, 1983

[54] TURBINE DISTRIBUTOR VANE

[75] Inventors: Denis R. G. Laffitte, Miramas; Guy H. Louis, Chartrettes; Alain M. M. Raybaud, Verneuil l'Etang, all of France

[73] Assignee: Societe Nationale d'Etude et de Construction de Moteurs d'Aviation "S.N.E.C.M.A.", Paris, France

[21] Appl. No.: 222,624

[22] Filed: Jan. 5, 1981

[30] Foreign Application Priority Data

Jan. 10, 1980 [FR] France ..... 80 00458

[51] Int. Cl.[3] ..... F01D 5/18

[52] U.S. Cl. ..... 416/96 A; 415/115; 416/97 R

[58] Field of Search ..... 415/115; 416/96 A, 96 R, 416/97 R

[56] References Cited

U.S. PATENT DOCUMENTS

| | | | |
|---|---|---|---|
| 3,370,829 | 2/1968 | Banthin et al. | 415/115 |
| 3,475,107 | 10/1969 | Auxier | 416/96 A X |
| 3,635,587 | 1/1972 | Giesman et al. | 416/96 A |
| 3,647,316 | 3/1972 | Moskowitz | 416/96 A |
| 3,782,852 | 1/1974 | Moore | 416/97 |
| 3,809,494 | 5/1974 | Redman | 416/97 |
| 4,063,851 | 12/1977 | Weldon | 416/96 A X |
| 4,168,938 | 9/1979 | Dodd | 416/97 |

FOREIGN PATENT DOCUMENTS

| | | | |
|---|---|---|---|
| 2071665 | 9/1971 | France . | |
| 2150476 | 4/1973 | France . | |
| 1374159 | 11/1973 | France . | |
| 2326570 | 4/1977 | France . | |
| 1467483 | 3/1977 | United Kingdom | 416/96 A |
| 2017229 | 10/1979 | United Kingdom | 416/96 A |
| 364747 | 3/1973 | U.S.S.R. | 416/96 A |

*Primary Examiner*—Philip R. Coe
*Assistant Examiner*—Frankie L. Stinson
*Attorney, Agent, or Firm*—Oblon, Fisher, Spivak, McClelland & Maier

[57] ABSTRACT

A turbine nozzle vane of the kind which includes at least one inner hollow portion inside which a corrugated sleeve positioned against the sides thereof against protruding components. The protruding components against which the sleeve stands are arranged along the inner side and the outer surface according to a zone that stretches throughout most of the height and the width of which, being optimal at the base, changes gradually along the entire height before becoming minimal at the upper portion.

7 Claims, 5 Drawing Figures

TURBINE DISTRIBUTOR VANE

BACKGROUND OF THE INVENTION

1. Field of the Invention

This invention concerns a turbine nozzle vane.

2. Description of the Prior Art

High performance turboshaft engines are equipped with directional turbine vanes that are able to resist temperatures neighboring 1,500° C. and it is even conceivable to use vanes that are able to operate at higher temperatures. Such vanes require an efficient cooling system and a system of very sophisticated inner channeling. It is known that turbine nozzle vanes are used that include at least one inner hollow inside which a peforated corrugated sleeve stands against the walls by way of protruding components. However, the arrangement of the protruding components including cylindrical studs and fins usually does not make it possible to obtain a sufficient thermal exchange coefficient for the envisioned operating temperatures.

SUMMARY OF THE INVENTION

In conformity with the present invention the protruding components against which the sleeve stands are arranged for the inner and outer walls according to a zone stretching along most of the entire height thereof to become minimal at the upper section, the inner hollow displaying an opening at its upper section by which the cooling fluid enters. That arrangement of protruding components according to the invention, which involves arranging them according to triangular-or trapeze-shaped zones, makes it possible to plan evolutive crossing areas such that the ratio of residual cool air flow and the passage cross section remains substantially constant. The result is better cooling of the vane walls.

According to one feature of the invention, the sleeve is kept pressed against the protruding components in the open position by a rigid blocking device like a longitudinal lock plate. That arrangement facilitates assembly and ensures proper placement of the sleeve which leads to adequate scaling of the circuits defined by the sleeve.

According to a characteristic of the invention, the main chamber which is located behind the leading edge inside which the sleeve is assembled is subdivided into three cooling zones that do not communicate with one another, thus improving cooling of the vane with air circulation.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
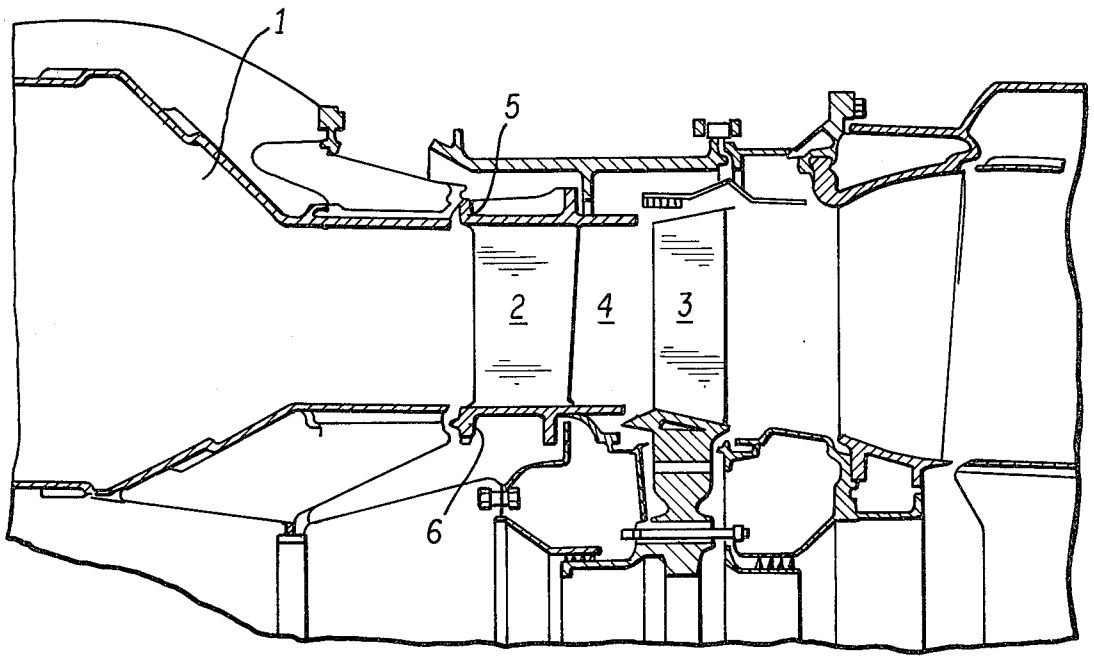
FIG. 1 is a half sectional lengthwise view of a turbojet engine turbine.

In FIG. 1 is shown a section of the turbine from a turbojet engine which is located at the exit of a combustion chamber 1 that includes a nozzle guide vane 2 and a turbine blade 3 which are located inside the annular discharge channel 4 for combustion gases. Guide vane 2 is part of a row of vanes that is arranged in circular fashion inside the discharge channel 4. Each vane 2 displays in a similar manner a head 5 and a foot 6 (FIGS. 1, 2, 3), head 5 including an opening 7 through which the cooling air enters which stems from the compressor. The air is distributed inside the various inner channels as will be described later. Each vane 2 includes a main chamber 8, an intermediate chamber 9, and a trailing edge 10, also visible in FIGS. 4 and 5.

In order to ensure efficient operation of the leading edge, which is especially crucial, the main chamber 8 takes up nearly ⅔ of the inner volume of the vane 2; thus making it possible to reduce the Mach number of the heat exchange fluid, therefore preserving a high pressure level. Also, to prevent premature warming of the cooling air, the latter is first channelled inside an inner corrugated sleeve 12 which isolates it from the walls.

Corrugated sleeve 12 includes two plates, a first plate **12*a* of which extends along the entire width of the main chamber 8 and a second plate 12*b* which is affixed to the first plate 12*a* in order to create an open Y-shaped sleeve at one of its extremities directed at the leading edge 11**.

Sleeve 12 is nearly fluidtight by way of engagement plate **12*a* against the central partition 13 that separates the main chamber 8 from the intermediate chamber 9 and abuts by plate 12*a* against cylindrical or truncated studs 14 located on the outer side thereof and further by plate 12*b* against crosswise fins 15** located on the inner side thereof.

Figure 3:
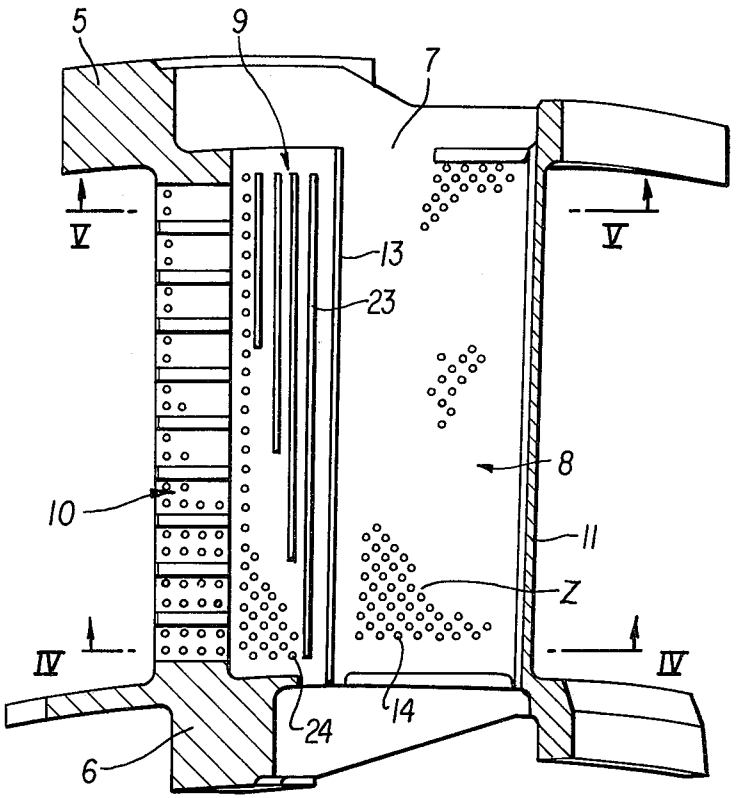
FIG. 3 is a lengthwise sectional view of a vane indicating the suction section that corresponds to the outer surface.
Figure 2:
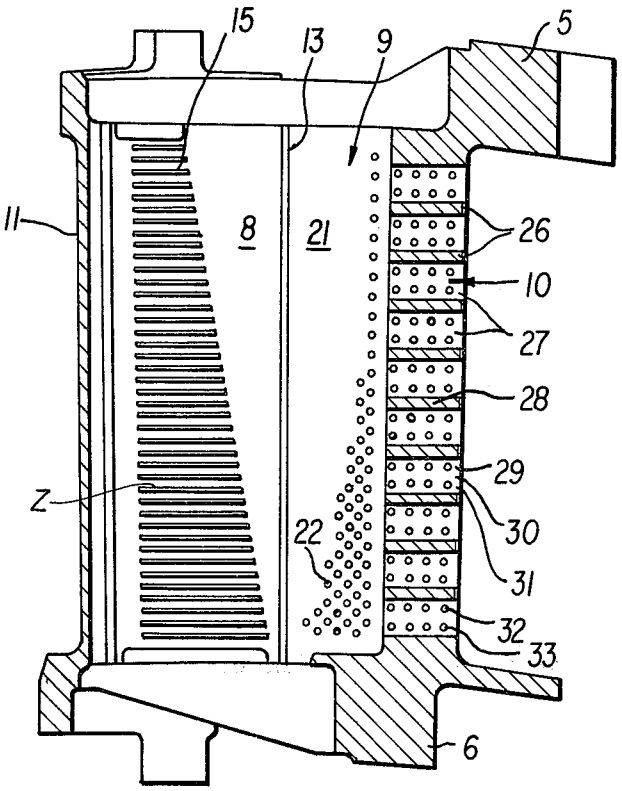
FIG. 2 is a lengthwise sectional view of a vane including the pressure section that corresponds to the inner surface.

Close to the leading edge 11, plates **12*a* and 12*b* of the sleeve 12 rest on two ribs 16, 16*a* and are sustained in an open position by a longitudinal lock 17 fitted inside ribs positioned inside the edges of the two plates 12*a*, 12*b*. Lock 17 consists of a plate that displays openings 17*a* which lead toward the leading edge 11. In conformity with the invention, the rows of cast studs 14 on the inner face of the outer wall as well as the crosswise fins 15 installed on the inner surface are arranged according to form a zone 2 which extends mostly throughout the entire height and the width of which, being optimal at the base adjacent foot 6, develops gradually along all of its height before becoming minimal at the upper section adjacent head 5 as best shown in FIGS. 2 and 3**.

Figure 4:
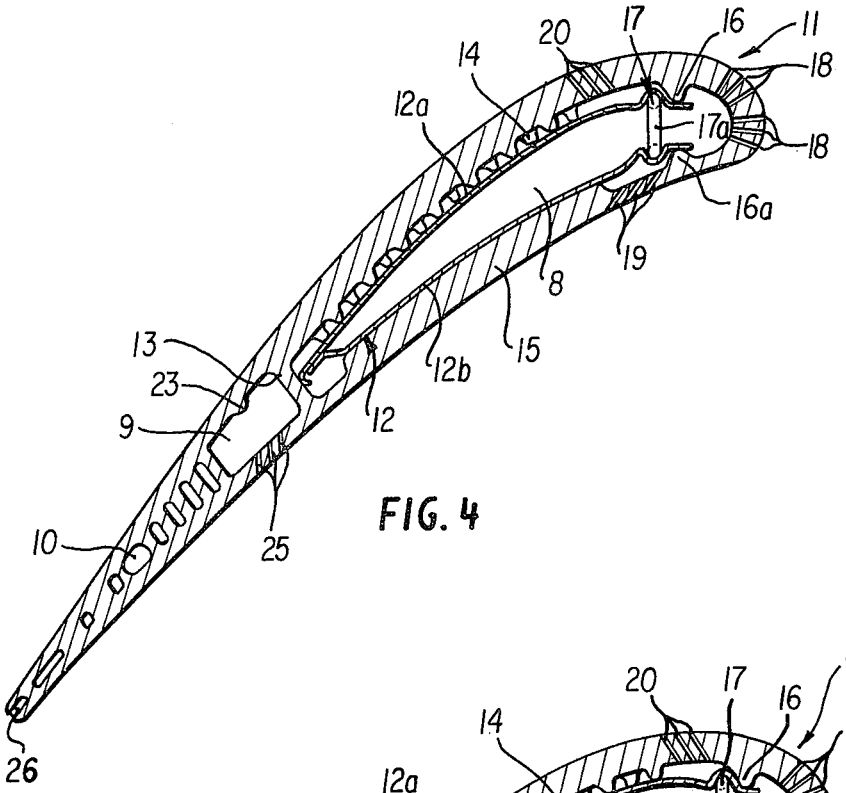
FIG. 4 is a sectional view of the vane according to line IV—IV of FIG. 3.
Figure 5:
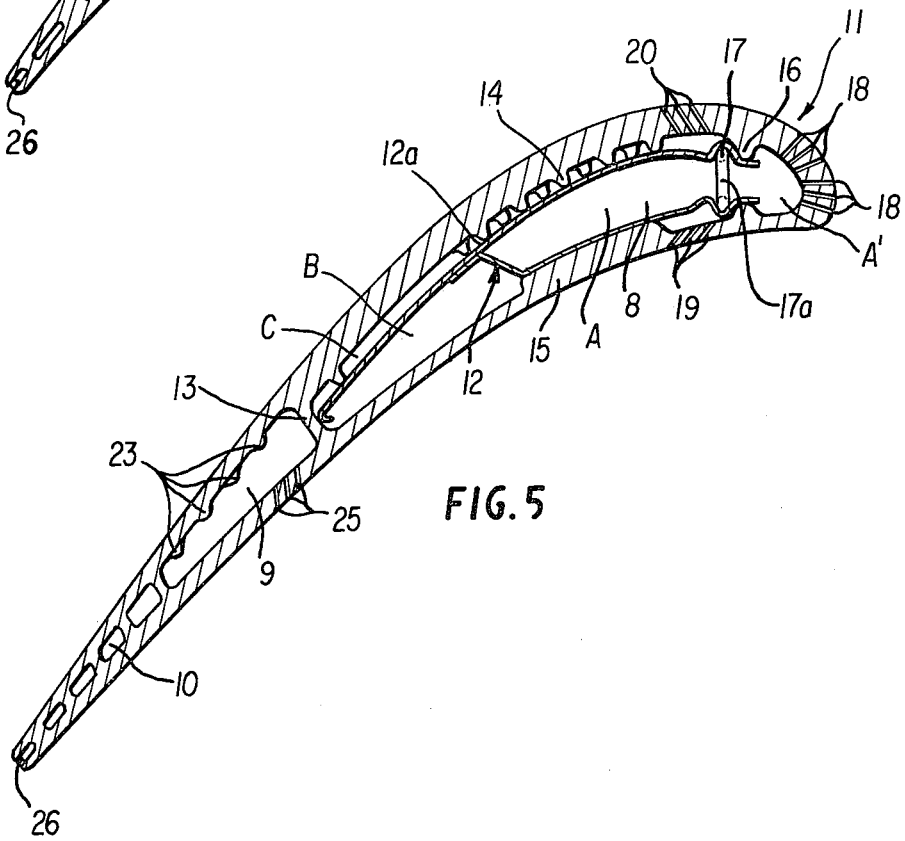
FIG. 5 is a sectional view of the vane according to line V—V of FIG. 3.

Such an arrangement of the protruding components 14 and 15 which consists of arranging them in a triangular or trapezoidal shape makes it possible to plan evolutive cross areas such that the ratio of residual cool air flow and crossing area remains substantially constant. As shown in FIGS. 4 and 5 the vane 2 includes rows of perforations 18 on the leading edge 11, rows of perforations 19 on the inner surface, close to the leading edge and to the inner partition and rows of perforations 20 on the outer surface close to the leading edge 11. According to a particular aspect of the invention, the diameter of those perforations is extremely small, on the order of 0.3 mm. A staggered arrangement of such perforations is preferred.

The aforementioned two peculiarities of the perforations lead to significant advantages with respect to thermal exchanges. The fact that a maximum number of perforations brought nearer together can be housed in the treated area implies that the film stabilizes rapidly, while the larger perforations may bring about heterogeneous developments in the exchanges. Hence optimal efficiency with minimal flow is obtained.

The arrangement of the sleeve 12 inside the main chamber 8 is such that it divides the chamber 8 into three independent zones A, B, C (see FIG. 5). The air comes through the head of zone A, crosses the lock 17 through the openings 17*a*, fills zone A', then comes into contact with the leading edge and escapes through perforations 18. The section of the entrance of chamber A (FIG. 5) is smaller than that of the base (FIG. 4) and the result is that the Mach number decreases at positions closer to the foot of the vane 2, the pressure varying in reverse. Thus, to a large extent the radial evolution of temperatures on the leading edge 11 is balanced.

The air coming through the opening 7 of the vane 2 is distributed also on the one hand inside zone B, crosses fins 15 and escapes through perforations 19, and, on the other hand, inside zone C, crosses studs 14 and escapes through perforations 20. The space inside zone B between sleeve 12 and fins 15 and inside zone C between sleeve 12 and studs 14 is small and allows a high Mach number and a small supply flow which is conducive to convection cooling.

The external exchange coefficient (calorie intake) is higher on the suction face than on the pressure surface, hence fins are used on the pressure surface and studs are used on the suction face. Such fin-induced cooling is less efficient but provides a much lower pressure drop. Studs 14 have a larger wet surface and generate turbulence which is conducive to exchanges.

The supply zone B of the fins 15 and the supply zone C of studs 14 diminish approaching the vane foot 6. Inversely, the length of the fins 3 or rows of studs 14 increases, which makes it possible to a large extent to balance the exchanges along the entire surface of the vane.

Intermediate chamber 9 includes on the pressure surface side (FIG. 2) a smooth section 21 in the shape of a right-angled triangle the base of which is defined by the upper portion of the chamber and the top by the inner lower corner. Along the same pressure surface side partition, cast rows of studs 22 are arranged in a right-angled triangle shape the top of which takes up the upper downward corner of chamber 9.

On the outer side, four longitudinal ribs 23 are also arranged according to a zone which is shaped like a right-angled triangle. Inside the open space rows of studs 24 are distributed in a staggered formation according to a zone shaped like right-angled triangle. There are no outlets to the back of the suction surface because the exchange coefficients are reversed (supplied by chamber 9) along the last third of the vane 3.

Hence three rows of perforations 25 are utilized (FIG. 4) along the pressure surface of the intermediate chamber 9. As in the case of perforations 18, 19, 20, the diameter of the perforations 25 is very small, about 0.3 mm and preferably a staggered arrangement is used.

The longitudinal grooves 23 and the rows of studs 24 are sufficient for cooling the suction surface. It should also be observed that, inside that zone the concentration of fins drops and that the concentration of studs increases approaching the vane foot. The intermediate chamber 9 leads to a groove 26 (FIG. 4, 5) that takes up the entire length of the leading edge through slits 7 separated by cast catches 28.

Slits 27 are subdivided into tracks 29, 30, 31 defined by two rows of studs 32, 33 linked to both the pressure surface and the outer side. Although a lock 17 was described as consisting of a perforated plate for maintaining the edges of the sleeve 12 in the open position, it is also possible to maintain the plates open by fitting the tips of the plates 12*a* and 12*b* inside slits formed inside the ribs 16, 16*a*.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A turbine nozzle vane having at least one inner hollow chamber formed therein comprising:

a corrugated Y-shaped sleeve positioned against opposite sides of said hollow chamber;

a first and second radial rib extending from each of said opposite sides of said chamber;

a first and second row of protruding elements extending from each of said opposite sides;

longitudinal lock means disposed in said chamber for positioning said sleeve against said protruding elements and for elastically pressing end portions of said sleeve against said radial ribs, said first and second rows of protruding elements forming a zone of said elements extending from each of said opposite sides throughout most of the height of each of said opposite sides of the vane, the width of the zone of said elements being maximal at a base portion of said zone and changing gradually along the entire height of said zone so as to become minimal at an upper portion thereof, said vane having an opening formed therein through which cooling fluid enters and which is located on a side of said opposite sides where the width of said zone of elements is minimal.

2. A turbine nozzle vane according to claim 1 wherein said chamber further comprises a main chamber formed therein behind a leading edge of said vane and further comprising a partition, and an intermediate chamber separated from said main chamber by said partition the main chamber and the intermediate chamber having positioned on pressure and suction side portions thereof said protruding elements such that said protruding elements are arranged according to differing substantially triangular zones.

3. A turbine nozzle vane according to claims 1 or 2, wherein said extending elements further comprise a plurality of studs on the suction side and a plurality of fins on the pressure side.

4. A turbine nozzle vane according to claim 2, said sleeve being Y-shaped and which further comprises first and second plates, said first plate extending throughout the entire width of the main chamber and the second plate being fixed to the first plate and extending outwardly substantially according to the width of the extending elements against which said second plate is pressed.

5. A turbine nozzle vane according to claim 4, wherein said first and second plates of said sleeve each have a groove formed therein and wherein said Y-shaped sleeve fluid tightly engages said partition, dividing said main chamber into first and second parts, wherein said first part further comprises an upstream part in which said extending elements cooperate with said partition and wherein said longitudinal lock means further comprises a longitudinal lock plate engaging said groove of each of said first and second plates and having openings formed therein to maintain the position of said sleeve, said upstream part being further divided by the lock plate into first and second chamber zones, wherein said second part further comprises third and fourth chamber zones divided by a longest branch portion of the Y-shaped sleeve and wherein said first and second chamber zones, said third chamber zone and said fourth chamber zone communicate, respectively, forming first, second and third air supply sources.

6. A turbine nozzle vane according to claim 5, the vane including a plurality of rows of perforations formed therein on the leading edge, a plurality of rows of perforations formed therein on the pressure side thereof adjacent to the leading edge and adjacent to the inner partition and, a plurality of rows of perforations formed therein on the suction side thereof adjacent to the leading edge wherein the rows of perforations are in a stagger formation and wherein the diameter of the perforations is approximately 0.3 mm.

7. A turbine nozzle vane according to claim 2, said vane having a plurality of bridge members, a plurality of track members, and a plurality of rows of studs defining said track member including a groove formed therein which extends the entire length of the trailing edge thereof by a plurality of slits formed therein separated by said bridge members, each of the slits being divided into said tracks defined by said plurality of rows of studs and being linked to both the pressure side and the suction side thereof.

* * * * *

UNITED STATES PATENT AND TRADEMARK OFFICE

CERTIFICATE OF CORRECTION

PATENT NO. : 4,403,917

DATED : SEPTEMBER 13, 1983

INVENTOR(S) : LAFFITTE, DENIS R.G.; MIRAMAS; LOUIS, GUY H.; CHARTRETTES; and RAYBAUD, ALAIN M.M.; VERNEUIL L'ETANG It is certified that error appears in the above-identified patent and that said Letters Patent is hereby corrected as shown below:

On the title page, column 1, line 3, delete "DISTRIBUTOR" and insert therefor --NOZZLE--;

In column 1, line 2, delete "DISTRIBUTOR" and insert therefor --NOZZLE--;

In column 1, line 16, delete "peforated" and insert therefor --perforated--;

In column 2, line 50, delete "2" and insert therefor --Z--;

In column 3, line 39, delete "3";

In column 3, line 51, delete "outer" and insert therefor --suction--;

In column 3, line 55, after "like" insert --a--;

In column 3, line 67, delete "of fins" and insert therefor --of the fins--;

UNITED STATES PATENT AND TRADEMARK OFFICE

CERTIFICATE OF CORRECTION

PATENT NO. : 4,403,917

DATED : SEPTEMBER 13, 1983

INVENTOR(S) : LAFFITTE, DENIS R.G.; MIRAMAS; LOUIS, GUY H.; CHARTRETTES; and RAYBAUD, ALAIN M.M.; VERNEUIL L'ETANG It is certified that error appears in the above-identified patent and that said Letters Patent is hereby corrected as shown below:

In column 4, line 6, delete "outer" and insert therefor --suction--.

Signed and Sealed this

*Sixth* Day of *March 1984*

[SEAL]

*Attest:*

GERALD J. MOSSINGHOFF

*Attesting Officer*

*Commissioner of Patents and Trademarks*